United States Patent [19]

Metiver

[11] Patent Number: 4,592,734

[45] Date of Patent: Jun. 3, 1986

[54] FOOT STRAP AND BASEPLATE ASSEMBLY

[76] Inventor: Richard Metiver, 935 Metivers Way, Watsonville, Calif. 95076

[21] Appl. No.: 739,522

[22] Filed: May 31, 1985

[51] Int. Cl.[4] ..... B63B 35/72

[52] U.S. Cl. ..... 441/74; 24/16 PB; 24/602; 280/623; 114/39

[58] Field of Search ..... 441/74, 75, 70; 114/39.2; 280/623, 614; 24/115 F, 587, 16 PB, 702, 602

[56] References Cited

U.S. PATENT DOCUMENTS

| | | | |
|---|---|---|---|
| 3,473,768 | 10/1969 | Piasecki | 24/16 PB |
| 3,501,814 | 3/1970 | Anderson et al. | 24/16 PB |
| 3,931,980 | 1/1976 | Marker | 280/623 |

FOREIGN PATENT DOCUMENTS

| | | | |
|---|---|---|---|
| 8100970 | 9/1982 | Netherlands | 114/39.2 |
| WO82/01525 | 5/1982 | PCT Int'l Appl. | 441/74 |

*Primary Examiner*—Trygve M. Blix

*Assistant Examiner*—Edwin L. Swinehart

*Attorney, Agent, or Firm*—Flehr, Hohbach, Test, Albritton & Herbert

[57] ABSTRACT

A foot strap and baseplate assembly for mounting on boards of the type used in surfboarding and windsurfing. Each assembly includes a pair of baseplates formed with cavities which open through the top along a slot and at the rear through a wedge-shaped doorway. A pair of elongated flexible straps are formed with enlarged proximal ends which releasably fit in the cavity of a respective baseplate. The shape of the cavity and corresponding shape of the strap proximal end, together with the predetermined hardness of the proximal end, cause the strap to engage in the cavity when the pulling force is below a predetermined limit, while disengaging when the force exceeds that limit whereby the strap is released to free the user's feet from the board. The straps flex and collapse to permit the user to lie flat on the board. The tops of the baseplates are rounded and have a low profile which facilitates alternate use of the board without the straps.

7 Claims, 5 Drawing Figures

FOOT STRAP AND BASEPLATE ASSEMBLY

This invention relates to the sports of surfboarding and windsurfing, and more particularly relates to surfboarding and windsurfing boards employing foot straps.

Foot straps have previously been attached to surfboards and windsurfing boards to increase the user's ability to stay on the board. Experienced surfers have occasion to utilize foot straps for acrobatics. For example, by employing foot straps a surfer can perform aerials in which the board is caused to temporarily leap or fly off the wave surface.

Foot straps of previously known design have a number of disadvantages and limitations. Among these are the inability of a surfer using these prior straps to quickly release from the board in an emergency, such as when the nose of the board digs into the water. Another disadvantage is that the prior foot straps do not readily collapse down such that it is difficult and uncomfortable for the surfer to lie flat on the board for swimming back to catch the next wave. Furthermore, these prior straps are not readily detachable from their mounting plugs such that the board cannot be optionally used in the normal way without the straps.

The foregoing problems are obviated or minimized in the present invention which provides a novel foot strap and baseplate assembly. A pair of baseplates are mounted in spaced-apart position at the location of the user's foot on the board. In each baseplate a cavity is formed with an internal bottom wall and opposing sidewalls which converge upwardly at a predetermined angle and open along a slot through the top of the baseplate. The cavity opens at the rear of the baseplate through a wedge-shaped doorway and is closed at the opposite end by the front end of the baseplate. A pair of flexibly elongated straps are each formed with an enlarged proximal end which is wedge-shaped commensurate in size and shape with the baseplate cavity. The strap is formed of an elastomer having a predetermined hardness which, in combination with the shape of the cavity, causes the straps to securely engage in the baseplates up to a predetermined limit of pulling force. When the pulling force on one or both of the proximal ends exceeds the predetermined limit then the strap automatically disengages from the baseplate, permitting the user to clear the board. Means are provided to detachably secure the distal ends of the strap together into a loop.

The foregoing and additional objects and features of the invention will appear from the following specification in which the preferred embodiment has been set forth in detail in conjunction with the accompanying drawings.

Figure 1:
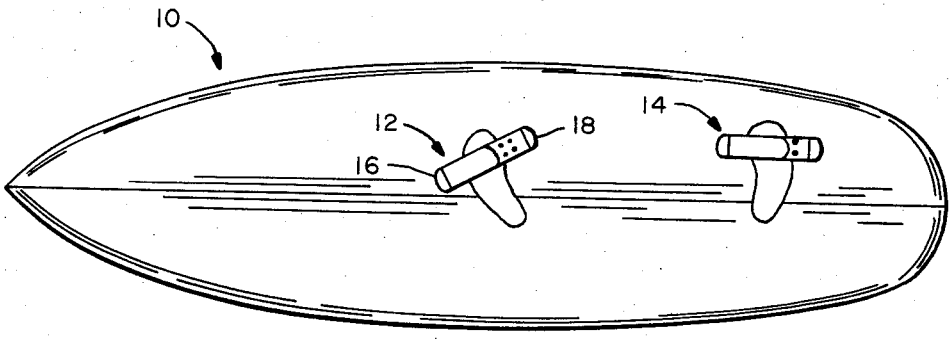
FIG. 1 is a top plan view of a surfboard showing the mounting of two foot strap and baseplate assemblies of the invention.

In the drawings, FIG. 1 illustrates generally at 10 a typical surfboard on which are mounted two foot strap and baseplate assemblies 12 and 14 incorporating a preferred embodiment of the invention. While the invention will be explained in relation to use on surfboards, it can also be used with boards of the type used in windsurfing.

Each of the assemblies includes a pair of baseplates and a pair of foot straps. The baseplates and foot straps for the two assemblies are identical in configuration and use and it will suffice to explain in detail the assembly 12 which is shown mounted at the front end of the board in FIG. 1.

Figure 2:
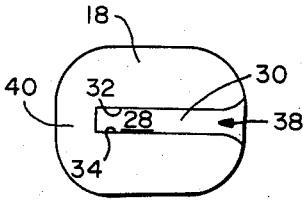
FIG. 2 is a top plan view to an enlarged scale of a baseplate employed in one of the assemblies showing in FIG. 1.
Figure 3:
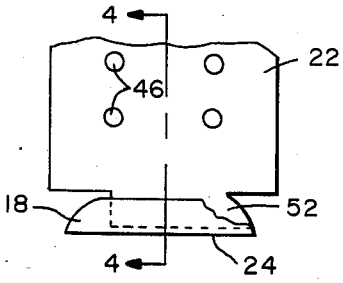
FIG. 3 is a side elevational view of the baseplate of FIG. 2 showing engagement of the proximal end of one of the foot straps.
Figure 4:
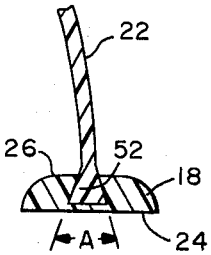
FIG. 4 is a cross-sectional view taken along the line 4—4 of FIG. 3.
Figure 5:
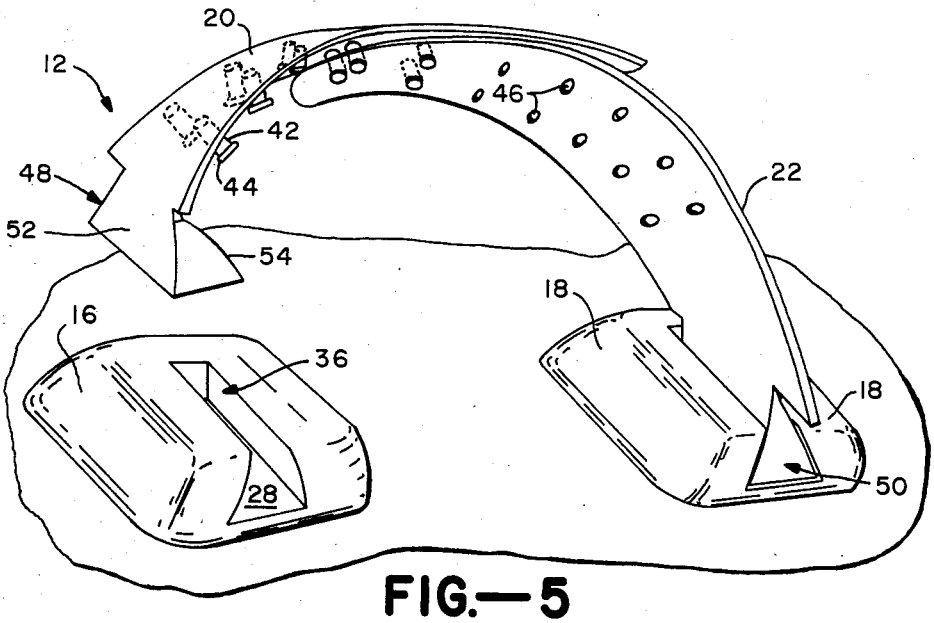
FIG. 5 is a perspective view to a further enlarged scale of one of the foot strap and baseplate assemblies of FIG. 1.

The assembly 12 comprises a pair of baseplates 16, 18 and a pair of foot straps 20, 22, best shown in FIG. 5. The baseplates are substantially identical in size and shape, and details of the typical baseplate 18 are shown in FIGS. 2–4. The baseplate is comprised of a body formed with a flat bottom 24 adapted to be secured to the surface of the board by a strong adhesive agent such as acrylic glue or epoxy resin. The top 26 of the baseplate body is rounded at its edges to form a low profile. A cavity 28 is formed within the body with an internal bottom wall 30 and opposing side walls 32, 34 which converge upwardly at an optimum predetermined angle A in the range of 45°–60°, depending on the elasticity of the material forming the straps. The side walls open through the top along a slot 36. The cavity opens at the rear through a wedge-shaped doorway 38 and the opposite end is closed by the front end 40 of the baseplate.

The pair of foot straps 20 and 22 are each formed of an elastomer material which is strong in tension and which has a predetermined hardness value in the range of 80 to 92 durometer to provide sufficient elastic resiliency which in combination with the specific angle between the cavity sidewalls achieves release of the straps from the baseplate in the manner described below. An example of an elastomer material suitable for use in the invention is a polyurethane having a durometer hardness of 91. Utilizing an elastomer with this hardness value the resiliency is such that an included angle between the proximal end sidewalls of 52° provides satisfactory performance.

Each of the straps includes means for detachably securing the distal ends together to form a loop and to permit adjustment of the loop about the user's foot. Preferably, the securing means includes a plurality of relatively small-diameter nibs 42 which are molded integral with and project from one side of the strap 20 in spaced-apart relationship along two rows. The tips of the nibs are formed with outwardly projecting rims 44. A plurality of apertures 46 are formed in the opposing strap 22 in spaced-apart relationship along two rows so that the apertures match with opposing nibs when the two straps overlay one another in the manner shown in FIG. 5. Hand pressure applied by the user forces the nibs through the apertures with the nib rims elastically springing out to catch on the opposite surface of the strap. The straps can be quickly decoupled by the user pulling back the outermost strap which causes the nibs to pull out of the apertures.

The straps are formed with enlarged proximal ends 48, 50 for releasable engagement into the cavity of a respective baseplate. The proximal strap ends are substantially commensurate in size and shape with the size and shape of the baseplate cavity into which they engage. That is to say, the proximal ends are wedge-shaped with side walls 52, 54 having an included angle substantially equal to the included angle A of the baseplate cavity. The lateral width between the sidewalls can advantageously be dimensioned slightly oversized to form an interference fit into the cavity and thereby increase the locking strength of the connection. The foregoing optimum sizing and configuration of the baseplate cavities and strap proximal ends, together with the predetermined hardness (and therefore elastic resiliency) of the elastomer which forms the straps, provides a secure connection at each strap end which withstands a pulling force up to a limit in the range of 80 to 100 lb. When the pulling force on one or both straps exceeds that limit, the proximal end of the strap resiliently deforms and is pulled through the baseplate slot from the wedging action of the cavity. The strap quickly releases from the baseplate due to the action of the proximal end pulling or pivoting up out of the slot and out the doorway 38 of the cavity.

The use and operation of the invention will be explained in relation to the surfboard 10 shown in FIG. 1. An adhesive agent is used to secure the pair of baseplates 16, 18 for assembly 12 on the top surface of the board in spaced-apart relationship on either side of the surfer's foot which is toward the front of the board, e.g., slightly offset to the right of the board's center line, where the surfer's left foot leads. In this case, the pair of baseplates for the assembly 14 are mounted to the rear of the board offset to the right of the center line in spaced-apart relationship at the position where the surfer's right foot is planted. The baseplates for each assembly are mounted so that their doorway cavities open in a direction toward the heel of the foot. At each assembly a strap 20 carrying the nibs is engaged with one of the baseplates by sliding the proximal end 48 through the doorway and into the cavity. Next the strap 28 with the apertures is secured to the opposing baseplate by engaging the proximal end 50 into the cavity in a similar manner. The pair of straps are then bent down into overlapping relationship to form a loop sized for the surfer's foot with the nibs pressed into the apertures.

With both sets of straps engaged the surfer can proceed to use the board with good traction. Acrobatics can be performed, such as aerials in which the surfer temporarily leaps or flies off the wave surface.

In emergencies, such as when the nose of the board digs into the water, the proximal ends of the straps automatically release from the baseplate when the strap pulling forces exceed the predetermined limit, thereby permitting the surfer to dismount the board.

The straps have sufficient flexibility so that they collapse down against the board from the weight of the surfer when lying flat. This permits the surfer to comfortably lie on the board such as when paddling back to catch the next wave. The straps can also be easily removed by pivoting the proximal ends back out through the doorway of the baseplate cavity. This permits optional use of the board in the normal manner without the straps because the baseplates with their relatively low profile and rounded corners and edges do not interfere with the surfer's feet.

While the foregoing embodiment is at present considered to be preferred, it is understood that numerous variations and modifications may be made therein by those skilled in the art and it is intended to cover in the appended claims all such variations and modifications as fall within the true spirit and scope of the invention.

What is claimed is:

1. A foot strap and baseplate assembly for use on boards for surfboarding and windsurfing sports comprising the combination of a pair of baseplates for mounting in spaced-apart relationship on the surface of the board, each baseplate comprising a body having a top, front and rear ends and a flat bottom for securing to the surface of the boards, means forming a cavity in each baseplate, the cavity having an internal bottom wall and opposing side walls which converge upwardly at an acute angle and open through the top along a slot, the cavity being open at the rear end through a wedge-shaped doorway and being closed at the opposite end by the front end of the body, a pair of elongated flexible straps, means for detachably securing the distal ends of the straps together, each strap being formed with an enlarged proximal end of an elastomer having a predetermined hardness which enables the proximal end to remain engaged in the cavity when the pulling force on the strap is below a predetermined limit, the proximal end resiliently deforming to disengage from the cavity when the pulling force on the strap at that proximal end exceeds the predetermined limit whereby the strap is released from the baseplate to free the user's feet from the board.

2. A foot strap and baseplate assembly as in claim 1 in which the acute angle is in the range of 45°–60°.

3. A foot strap and baseplate assembly as in claim 1 in which the enlarged proximal end of each strap is substantially commensurate in size and shape with the cavity of the baseplate into which it engages.

4. A foot strap and baseplate assembly as in claim 1 in which the elastomer of the enlarged proximal end has a durometer hardness in the range of 80 to 92 so that the side walls of a proximal end deform and disengage from the cavity when the pulling force exceeds substantially 100 lb.

5. A foot strap and baseplate assembly as in claim 1 in which the straps are formed of an elastomer which resiliently flexes to permit the straps to collapse against the board when the user lies flat on the board over the straps.

6. A foot strap and baseplate assembly as in claim 1 in which the means for detachably securing the straps comprises means forming a plurality of apertures spaced-apart along the first strap of the pair, and means forming a plurality of nibs spaced-apart along one side of the other strap of the pair, each nib being sized and positioned for releasable engagement into a corresponding aperture on the first strap.

7. A foot strap and baseplate assembly as in claim 1 in which the top of each baseplate is rounded with a low profile to facilitate alternate use of the board without the straps.

* * * * *